US008685174B2

(12) United States Patent
Goyal et al.

(10) Patent No.: US 8,685,174 B2
(45) Date of Patent: Apr. 1, 2014

(54) PROCESS FOR CLEANING HARD SURFACES

(75) Inventors: Richa Sureshchand Goyal, Bangalore (IN); Kirtan Shravan Kamkar, Bangalore (IN); Amit Sah, Bangalore (IN); Rudra Saurabh Shresth, Bangalore (IN); Narayanan Subrahmaniam, Bangalore (IN); Stephen John Singleton, Wirral (GB)

(73) Assignee: Conopco, Inc., Englewood Cliffs, NJ (US)

( * ) Notice: Subject to any disclaimer, the term of this patent is extended or adjusted under 35 U.S.C. 154(b) by 54 days.

(21) Appl. No.: 13/390,436

(22) PCT Filed: Aug. 9, 2010

(86) PCT No.: PCT/EP2010/061554

§ 371 (c)(1),
(2), (4) Date: Feb. 14, 2012

(87) PCT Pub. No.: WO2011/020731

PCT Pub. Date: Feb. 24, 2011

(65) Prior Publication Data

US 2012/0138103 A1 Jun. 7, 2012

(30) Foreign Application Priority Data

Aug. 19, 2009 (IN) ..... 1902/MUM/2009

(51) Int. Cl.
*B08B 3/02* (2006.01)

(52) U.S. Cl.
USPC ..... 134/36; 134/34; 134/37

(58) Field of Classification Search
USPC ..... 134/34, 36, 37, 38, 39, 40, 41, 42, 94.1, 134/99.1, 99.2, 100.1, 102.1, 102.2
See application file for complete search history.

(56) References Cited

U.S. PATENT DOCUMENTS

| | | | |
|---|---|---|---|
| 3,021,702 | A | 2/1962 | Houser |
| 3,108,465 | A | 10/1963 | Bochan |
| 4,127,913 | A | 12/1978 | Monson |

(Continued)

FOREIGN PATENT DOCUMENTS

| | | | |
|---|---|---|---|
| CH | 423720 | A | 11/1966 |
| CH | 423720 | | 11/1996 |

(Continued)

OTHER PUBLICATIONS

PCT International Search Report in PCT application PCT/EP2010/061554 dated Apr. 14, 2011 with Written Opinion.

(Continued)

*Primary Examiner* — Michael Kornakov
*Assistant Examiner* — Ryan Coleman
(74) *Attorney, Agent, or Firm* — Greenberg Traurig, LLP

(57) ABSTRACT

The present invention is in the field of household cleaning tools. The invention further relates to the use of an air-water jet for the cleaning of hardsurfaces. It is an object of the present invention to provide easier cleaning of hard surfaces. It is therefore an object of the present invention to provide a process of easier cleaning of hard surfaces, especially by means of a device that uses a relatively low water flow rate. Surprisingly it has been found that an external mix air-water jet device may be used for cleaning hard surfaces.

10 Claims, 4 Drawing Sheets

(56) References Cited

U.S. PATENT DOCUMENTS

| | | | | |
|---|---|---|---|---|
| 4,286,949 | A * | 9/1981 | Holt, Jr. | 433/103 |
| 4,569,483 | A | 2/1986 | Oberdorfer | |
| 4,787,404 | A | 11/1988 | Klosterman | |
| 4,793,332 | A | 12/1988 | Klein | |
| 4,998,993 | A | 3/1991 | Kenderi | |
| 5,001,806 | A | 3/1991 | Gurstein | |
| 5,505,915 | A | 4/1996 | Copeland | |
| 5,593,304 | A | 1/1997 | Ram | |
| 5,820,373 | A | 10/1998 | Okano | |
| 5,930,858 | A | 8/1999 | Jung | |
| 5,943,723 | A | 8/1999 | Hilfinger | |
| 5,960,503 | A | 10/1999 | Del Pozo Y Mattei | |
| 5,974,615 | A | 11/1999 | Schwarz-Hartmann | |
| 6,386,466 | B1 | 5/2002 | Ozawa | |
| 6,547,974 | B1 | 4/2003 | Albrechta | |
| 7,021,571 | B1 | 4/2006 | Lawson | |
| 8,016,949 | B2 | 9/2011 | Jayaraman | |
| 2002/0059947 | A1 | 5/2002 | Sato | |
| 2002/0189641 | A1 | 12/2002 | Sato | |
| 2003/0205631 | A1 | 11/2003 | Barron | |
| 2004/0087158 | A1 | 5/2004 | Izumi | |
| 2004/0202980 | A1 * | 10/2004 | Policicchio | 433/88 |
| 2004/0261817 | A1 * | 12/2004 | Araki et al. | 134/2 |
| 2006/0078844 | A1 | 4/2006 | Goldman | |
| 2008/0006303 | A1 * | 1/2008 | Butterbaugh et al. | 134/26 |
| 2008/0135639 | A1 | 6/2008 | Winters | |
| 2008/0283090 | A1 * | 11/2008 | DeKraker et al. | 134/3 |
| 2008/0295864 | A1 | 12/2008 | Turner | |

FOREIGN PATENT DOCUMENTS

| | | | |
|---|---|---|---|
| DE | 202005019242 | U | 8/2006 |
| DE | 202005019242 | U1 | 8/2006 |
| EP | 0140505 | A1 | 5/1985 |
| EP | 0248638 | A2 | 12/1987 |
| EP | 0790809 | B1 | 12/1998 |
| EP | 0862390 | B1 | 9/1999 |
| EP | 1250959 | A1 | 10/2002 |
| EP | 1306136 | A1 | 5/2003 |
| EP | 1737025 | A1 | 12/2006 |
| EP | 1870381 | A1 | 12/2007 |
| FR | 1014273 | | 8/1952 |
| FR | 1094132 | | 5/1955 |
| FR | 1108989 | | 1/1956 |
| FR | 1281617 | | 1/1962 |
| FR | 2583630 | | 12/1986 |
| FR | 2583630 | A1 | 12/1986 |
| GB | 1049162 | | 11/1966 |
| JP | 03296475 | A | 12/1991 |
| JP | 2000317412 | | 11/2000 |
| JP | 2001321391 | | 11/2001 |
| WO | WO8403237 | A1 | 8/1984 |
| WO | WO9936499 | | 7/1999 |
| WO | WO02072274 | A1 | 9/2002 |
| WO | WO03102289 | A1 | 12/2003 |
| WO | WO2006041920 | A1 | 4/2006 |
| WO | WO2008155025 | A1 | 12/2008 |
| WO | WO2009103595 | A1 | 8/2009 |
| WO | WO2011020730 | A1 | 2/2011 |
| WO | WO2011020731 | A3 | 2/2011 |
| WO | WO2011020733 | A3 | 2/2011 |
| WO | WO2011020734 | A2 | 2/2011 |

OTHER PUBLICATIONS

European Search Report in EP application EP 09 17 3657 dated Apr. 30, 2010.

PCT International Search Report in PCT application PCT/EP2010/061556 dated Apr. 14, 2011 with Written Opinion.

European Search Report in EP application EP 09 17 3659 dated Feb. 11, 2010.

PCT International Search Report in PCT application PCT/EP2010/061557 dated Apr. 14, 2011 with Written Opinion.

European Search Report in EP application EP 09 17 3663 dated Nov. 30, 2009.

PCT International Search Report in PCT application PCT/EP2010/061552 dated Nov. 5, 2010 with Written Opinion.

European Search Report in EP application EP 09 17 3652 dated Apr. 30, 2010.

* cited by examiner

Top view

Side view

PROCESS FOR CLEANING HARD SURFACES

TECHNICAL FIELD

The present invention is in the field of household cleaning tools. The invention further relates to the use of an air-water jet for the cleaning of hard surfaces.

BACKGROUND AND PRIOR ART

Cleaning hard surfaces, such as kitchen, bathroom, floor and/or window surfaces, is a cumbersome activity. The dirt, soil and/or stains deposited on such surfaces, varies from for instance, but not limited to, lime scale and soap scum on bathroom surfaces, to burnt on oil on cooker tops, to algae on windows and mud on floors.

Brushes, wipes, cloths and scouring pads are commonly used to achieve improved cleaning, but their use involves substantial physical activity. Detergent compositions, are generally used to loosen or dissolve the dirt, soil and/or stains.

High pressure water jet cleaning tools are sometimes used outdoors to clean surfaces, while steam devices are available for cleaning indoors. High pressure water jets use a lot of water for cleaning, which is less preferable indoors, while the steam devices result in high temperature and humidity inside the house, which is also not appreciated by the consumer.

Small scale water jet devices have been disclosed in the art. FR-B-1108989 discloses a process to clean a substrate by subjecting the substrate to an air-water spray generated by a spraying means comprising an air passage and a water passage.

US 2002/189641 discloses a device for cleaning a soiled surface, the device comprising a feed water container and an air compressor in communication with the spray nozzle comprising a water passage and an air passage.

Both of the above mentioned devices provide an air water spray that is mixed inside the device. The disadvantage of such system is that the water flow cannot be reliably regulated because the air pressure goes against the water flow direction. This is especially problematic when a low water-to-air ratio (for instance in water:air ratios of less than 1:9) is required or a low water flow-rate is used. The nozzles of the prior art are generally not suitable for this purpose.

A novel air-water jet device is described in our co-pending application PCT/EP2009/050869 (published as WO2009/103595). This device provides a small and powerful air-water jet that uses only small volumes of water for cleaning and a reliable water flow-rate independent of the air pressure, because of the external mixing of air and water, compared to the internal mixing of other devices.

It is an object of the present invention to provide easier cleaning of hard surfaces.

It is a further object to provide a process for cleaning hard surfaces using an air-water jet.

It is yet a further object to provide a process for cleaning hard surfaces using a device having relatively low water flow rate.

Surprisingly it has been found that an external mix air-water jet device may be used for cleaning hard surfaces.

SUMMARY OF THE INVENTION

Accordingly, the present invention provides a process for cleaning a hard surface with a cleaning device comprising an air-water jet device comprising two nozzles wherein a first nozzle is in fluid communication with a feed water source; and a second nozzle is connected to a source of compressed air; and characterised in that both nozzles are positioned relative to a central axis, wherein the first nozzle is at an angle of between 1 and 60° relative to the central axis; and the second nozzle is at an angle of between 1 and 45° relative to the central axis wherein the mouth of the second nozzle is positioned more forward in the direction of the flow along the direction of the central axis than the mouth of the first nozzle, wherein the offset distance between the mouth of the first nozzle and the second nozzle is between 0.5 and 5 mm in said direction.

These and other aspects, features and advantages will become apparent to those of ordinary skill in the art from a reading of the following detailed description and the appended claims. For the avoidance of doubt, any feature of one aspect of the present invention may be utilised in any other aspect of the invention. The word "comprising" is intended to mean "including" but not necessarily "consisting of" or "composed of." In other words, the listed steps or options need not be exhaustive. It is noted that the examples given in the description below are intended to clarify the invention and are not intended to limit the invention to those examples per se. Similarly, all percentages are weight/weight percentages unless otherwise indicated. Except in the operating and comparative examples, or where otherwise explicitly indicated, all numbers in this description indicating amounts of material or conditions of reaction, physical properties of materials and/or use are to be understood as modified by the word "about. Numerical ranges expressed in the format "from x to y" are understood to include x and y. When for a specific feature multiple preferred ranges are described in the format "from x to y", it is understood that all ranges combining the different endpoints are also contemplated.

DETAILED DESCRIPTION OF THE INVENTION

The present invention thus relates to a device for cleaning hard surfaces comprising an air-water jet. It is preferred that the air-water jet of the invention is incorporated into a hand held device, wherein the nozzles are positioned into a head, while at least part of the peripheral part may be incorporated in a handle.

Air-Water Jet

The air-water jet device comprises two nozzles wherein a first nozzle is in fluid communication with a feed water source; and a second nozzle is connected to a source of compressed air.

The water source may be any water source, either provided to the air-water jet device straight from the water mains, through a pump, through a pressured container holding the water or by any other means, or even by gravity (i.e. by placing the water reservoir above the height of use of the air-water jet.

Similarly, the air source may be any air source, either provided through a compressor, separate from or built into the tooth cleaning device, or through a compressed air line, such as often available in hospitals.

Both the first nozzle (water nozzle) and the second nozzle (air nozzle) are positioned relative to an imaginary central axis (NOR). The first nozzle is positioned at an angle ($\alpha$) of between 1° and 60°, preferably between 15° and 45° relative to the central axis; and the second nozzle is at an angle ($\phi$) of between 1° and 45°, preferably between 15° and 30° relative to the central axis.

The mouth (opening) of the second nozzle is positioned more forward in the direction of the flow along the direction of the central axis than the mouth (opening) of the first nozzle, wherein the offset (OS) distance between the mouth of the first nozzle and the second nozzle is between 0.5 and 5 mm in said direction, preferably 1-3 mm.

The best results are obtained when the first nozzle has an opening of between 0.05 and 10 $mm^2$, preferably even at least 0.2 $mm^2$, and not more than 7 $mm^2$, more preferably not more than 5 $mm^2$ or even less than 3 $mm^2$. Similarly, the opening of the second nozzle is preferably between 0.2 and 3 $mm^2$.

The scope of the present invention further includes configurations comprising two or more water nozzles directed at a single air nozzle. However, this increases the complexity of the device and is therefore not always preferred.

For nozzles with a circular opening, the diameter of the first nozzle is preferably between 0.25 and 3.5 mm, preferably at least 0.5 mm, but preferably not more than 3 mm, more preferably not more than 2.5 mm, or even less than 3 mm; while the diameter of the second nozzle is preferably between 0.5 and 2 mm.

Without wishing to be bound by a theory, it is thought that the present invention derives its performance from the positioning of the nozzles relative to the imaginary axis and the offset of the water nozzle (first nozzle) relative to the air nozzle (air nozzle). Because of this positioning, the water coming from the water nozzle forms a film around the air nozzle and because of this, it gives a finer spray at a lower water to air ratio (i.e. using less water). The air flow from the air nozzle is thought to create a local under-pressure that ensures that the water is driven in the direction of the air nozzle along the air nozzle tip regardless of in which direction the nozzle is pointed. Furthermore, the water flow is not affected by the air pressure, due to the separation of the air and water nozzle openings, which is a common problem with internal mix nozzle designs.

It is therefore preferred that the water:air ratio is between 10:90 and 1:9999, more preferably less than 5:95, still more preferably less than 4:96, even more preferably less than 3:97, less than 2:98 or even less than 1:99, while the ratio is preferably higher than 3:9997, more preferably higher than 5:9995.

It is further preferred that there is only a short distance between the opening of the water nozzle and the side of the air nozzle, this distance is preferably less than 2 mm, more preferably less than 1 mm, or even less than 0.5 mm. It is most preferred that the opening of the water nozzle touches the air nozzle.

It is preferred that the air nozzle does not co-axially surround the water passage. It is also preferred that the water nozzle does not co-axially surround the air nozzle.

The air pressure of the air source preferably is in the range of 1 to 4 bar. The air preferably has a velocity of greater than 80 m/s at the exit of the nozzle (the nozzle opening), preferably greater than 120 m/s, more preferably greater than 180 m/s, most preferably greater than 250 m/s. Although the invention would work up to very high air speeds, it is preferred for constructional reasons and convenience for the user that the air speed is less than the speed of sound (i.e. less than 334 m/s). Depending on the nozzle diameter, and the airflow rate is preferably between 3 and 50 l/min, preferably more than 5 l/min or even more than 10 l/min. The air flow rate is preferably less than 40 l/min, more preferably less than 30 l/min or even less than 25 l/min.

The water flow rate is typically between 2 and 50 ml/min, preferably more than 5 ml/min or even more than 10 ml/min, while the water flow rate is preferably less than 40 ml/min, preferably less than 30 ml/min or even less than 25 ml/min.

Configuration

The air and/or water sources may be incorporated into the device, or be fitted in a separate unit. In the latter case, a separate unit comprising a compressor, a compressed air cartridge or cylinder or another source of air and/or a water reservoir optionally connected to the water mains is provided that is connected to a hand held device by means of a tubing as air line and/or water line.

Head

The head of the device, preferably a hand held device comprises the air-water jet. The use of more than one air-water jet devices is also contemplated. The head may further comprise bristles and/or other abrasive and/or scouring elements.

The brush head may further be electrically operated. In this respect, the brush head may be driven by an electric motor incorporated into the handle of the device. The motor may move the head back and forth linearly in the direction of the handle, back and forth transverse at a 90° angle with said direction, back and forth over an angle of 1-180°, preferably 1-90° or even 1-45° around an axis in the direction of the handle, in a circular motion around an axis transverse to the direction of the handle, or back and forth over an angle of 1-180°, preferably 1-90° or even 1-45° around an axis transverse to the direction of the handle; or a combination thereof. In all the above configurations the air-water jet and the optional bristles and other elements are preferably pointing in a direction that is transverse to the handle of the tooth cleaning device.

The cleaning device may further comprise an air compressor as air source. The compressor may be built into the handle of the device, or provided as a separate device that is connected to the air-water jet by means of a tube. The compressor preferably provides at least 1 bar pressure and not more than 5 bar, preferably less than 4 bar. Thus, very low power compressors, typically in the range of 0.05 to 1 HP, can be used to achieve the above specifications. Due to a pressure drop in the tubing and the device, the pressure at the air nozzle will preferably be in the range of 1 to 4 bar, preferably 2 to 3 bar. A device with a means to set the pressure is also contemplated; in this case the user is for instance able to choose between soft, medium and hard cleaning.

The water source may be the water mains, i.e. directly connected to the faucet, or be in the form of a separate reservoir. The water pressure for use with the cleaning device may be relatively low, preferably at least 0.05 bar, more preferably at least 0.1 bar, but preferably not more than 3 bar, more preferably less than 2.5 bar, still more preferably less than 2 bar.

When a separate reservoir is used as water source, said reservoir may be filled with water only, or a cleaning composition. It is understood that in the context of this invention, terms like "water source", "water reservoir" and "water nozzle" are not limited to water, but include also cleaning compositions, preferably aqueous cleaning compositions.

The water reservoir may be placed above the level of use of the cleaning device, such as to provide pressure, or may be pressured separately. When pressured separately, it is especially preferred that the reservoir is pressurised with compressed air from the compressed air source.

Cleaning Composition

The cleaning composition may be in solid form, but is preferably a liquid. A liquid composition is most preferred. When a liquid composition is used, it may be used directly as water source, or may be diluted into the water source by means of a dosing device. Refill cartridges that may be clicked, screwed or pressed into or onto the device are also contemplated. Similarly, such cartridges may be used instead of a water source or on top of such source and diluted into the water by means of a dosing device.

The cleaning compositions in the context of the present invention include any composition that comprises a liquid and one or more benefit agents. Such benefit agents may be dependent on the intended use, such as bleaching agents, perfumes, polymers, dyes, solvents etc.

Surfactant

In general, the surfactants of the surfactant system may be chosen from the surfactants described well known textbooks like "Surface Active Agents" Vol. 1, by Schwartz & Perry, Interscience 1949, Vol. 2 by Schwartz, Perry & Berch, Interscience 1958, and/or the current edition of "McCutcheon's Emulsifiers and Detergents" published by Manufacturing Confectioners Company or in "Tenside-Taschenbuch", H. Stache, 2nd Edn., Carl Hauser Verlag, 1981.

The surfactant may be selected from anionic, non-ionic, cationic, zwitterionic and/or amphoteric surfactants.

Most preferred are non-ionic surfactants, such as C8-C22, preferably C8-C16 fatty alcohol ethoxylates, comprising between 1 and 8 ethylene oxide groups The composition may further comprise an anionic surfactant, such as primary alkyl sulphate, secondary alkyl sulphonates, alkyl benzene sulphonates, or ethoxylated alkyl sulphates.

Anionic surfactants may be selected from Alkyl Ether Sulphate preferably those having between 1 and 3 ethylene oxide groups, both from natural or synthetic source and/or sulphonic acid. Especially preferred are sodium lauryl ether sulphates.

Alkyl polyglucoside may be also be present in the composition, preferably those having a carbon chain length between C6 and C16.

A surfactant concentration based on the water that comes out of the nozzle is between 0.01 and 10% w by weight, preferably less than 7% w. The concentration is preferably more than 0.1% w. Bathroom and kitchen cleaners generally have a surfactant concentration of from 1 to 5% w, preferably from 2 to 4% w. General purpose cleaners and window generally have a concentration of from 1 to 3% w.

Polymer

To improve the accuracy and stability of the liquid flow rate, the viscosity and rheological behaviour of the formulation may be adjusted by the addition of one or more polymers.

Polymers may also be added to provide surface modification, by applying a polymer to a surface that there after enables easier after soil or stains have been deposited onto the surface.

Preferred polymers are acrylic polymers, xanthan gums, and polyacrylates.

The polymer is preferably present in the composition in a concentration of between 0.01 and 2% by weight of the composition. Preferably the polymer is present in a concentration of at least 0.02% w, more preferably 0.05% w, but typically not more than 1% w or even not more than 0.5% w.

Anti Microbial

Cleaning compositions, especially general purpose cleaning compositions, may comprise an anti microbial agent.

Anti microbial agents are bleaching agents, such as peroxygen bleaching agents (e.g. percarbonate or perborate) or hypohalite bleaches (e.g. sodium hypochlorite, calcium hypochlorite or bleaching powder). Alternatively, cationic biocides may be used to obtain an anti microbial benefit, such as benzalkonium chloride (benzyl ammonium chloride having a carbon chain length of between C10 and C16).

Hypohalite containing composition, preferably comprise a hypohalite bleach stabiliser.

pH

The pH may be reduced with any organic or inorganic acid or combinations thereof, and increased with any suitable organic or inorganic base or combinations thereof. Suitable acids are for instance citric acid, sulphamic acid and phosphoric acid. Suitable bases are for instance caustic soda and ammonia.

For bathroom cleaning compositions the pH is preferably in the range of 1-6, more preferably 2.5-5.

For kitchen cleaning compositions the pH is preferably in the range of 7-13, more preferably 7-12.

For multi purpose cleaning compositions, without antibacterial action the pH is in the range of 2-8, preferably 3-7. To obtain antibacterial action, the pH is typically less than 2, or even less than 1.

For general purpose cleaning compositions and window cleaning compositions, the pH is preferably in the range of 7-12, more preferably 9-11.

For general purpose cleaning compositions comprising bleach or cationic biocides for anti microbial action, the pH is preferably in the range of 7-14, more preferably 10-12.

For liquid abrasive cleaning compositions, the pH is preferably in the range of 8-12, more preferably 10-12.

Solvents

The compositions may further comprise a solvent. The solvent may be selected from glycol ethers, amino derivate alcohols (e.g. mono ethanol amine), ammonia.

The solvent is preferably present in the composition in a concentration of from 0.1 to 10%, more preferably less than 5%, more preferably less than 4%, but typically more than 0.5%.

Abrasive Material

The cleaning compositions may optionally comprise an abrasive particle, e.g. calcium carbonate (calcite), magnesium carbonate, polymeric abrasives or abrasives derived from a natural source (e.g. coconut shell particles). The abrasive particle is preferably present in the composition in a concentration of between 0.1 and 10%. It is preferred that the particles are smaller than the mouth of the water nozzle, preferably the maximum particle size is less than 500 micrometer. The average particle size may be between 1 and 250 micrometer, more preferably between 10 and 200 micrometer, still more preferably between 5 and 150 micrometer.

Operation

While cleaning, the air-water jet may be used continuously, or discontinuously. One way of operation that is considered is to use the air-water jet during part of the cleaning. In another embodiment the air-water jet is used in the first part of the cleaning process for cleaning and run with only the water flow or the water flow and low air flow to deposit a benefit agent to the surface.

In another embodiment the air-water jet is operated in a pulsed mode i.e. the air flow is controlled in an on-off fashion over time. In yet another embodiment the handheld device is fitted with a push button to switch the air-water jet on or off while cleaning.

In any of the discontinuous operations it is preferred to open and shut the air and/or water lines with a suitable valve, such as a solenoid valve.

A valve system may also be used to open the water and/or air lines when the device is in operation, while shutting the water and/or air lines when the device is not in use.

The invention will now be illustrated with reference to the following non-limiting figures and examples. The embodiments and examples are by way of illustration only and do not limit the scope of invention in any manner.

DETAILED DESCRIPTION OF THE DRAWINGS

Figure 1:
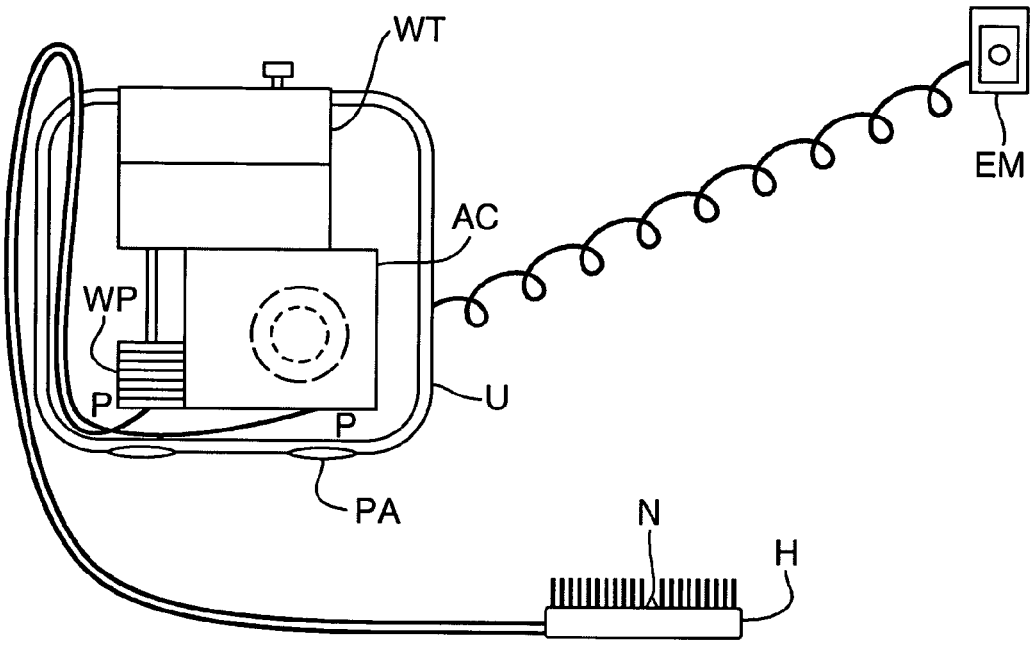
FIG. 1 is a schematic of a hand held embodiment of the device of the invention

Referring to FIG. 1, the device of the invention is embodied as a hand held system and shows the main unit (U) connected to the hand held device (H2). The device comprises an air compressor (AC) which weighs about 3 kg and runs on a motor that is rated at 130 W. The compressor is therefore light and easy to carry around like a household iron box for ironing clothes. The air compressor (AC) runs on electric power either from an electricity mains wall outlet (EM) or from a set of batteries. A container for liquid (CW) is provided for feeding the liquid or surfactant solution to the device. The liquid is fed to the nozzle (N) through a tube (PW) from the water pump (WP). Another tube (PA) feeds the compressed air from the air compressor (AC) to the nozzle (N). Air pressures of the order of 1 to 5 bar can be generated using this embodiment of the invention. The nozzle (N) is an external mix nozzle as is evident from FIG. 1.

Figure 2:
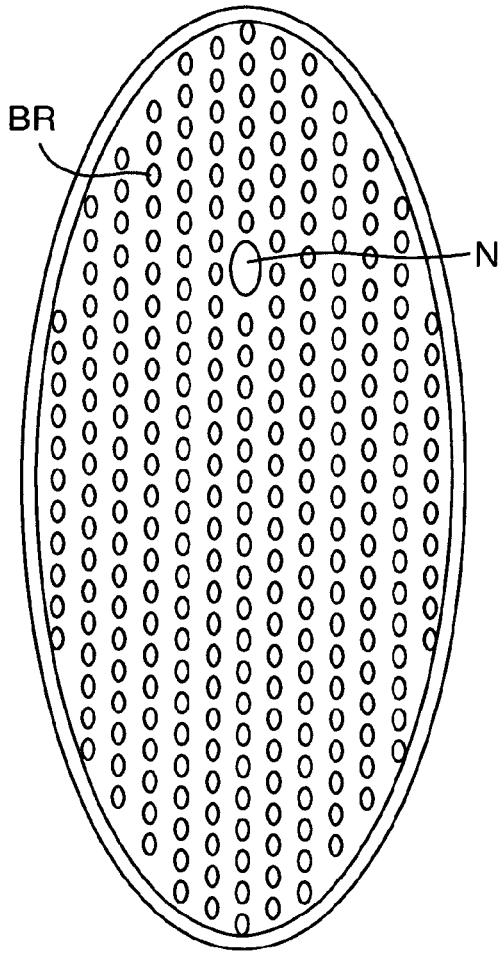
FIG. 2 is a schematic of a blown up view of the brush head
Figure 2:
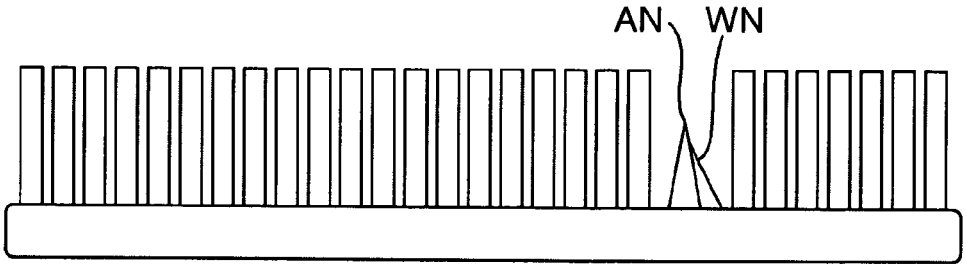

FIG. 2 shows a hand held device comprising the air-water jet comprising two nozzles (N), one for air (AN) and one for water (WN) and bristles (BR). The nozzle is an external mix nozzle with an off-set.

Figure 3:
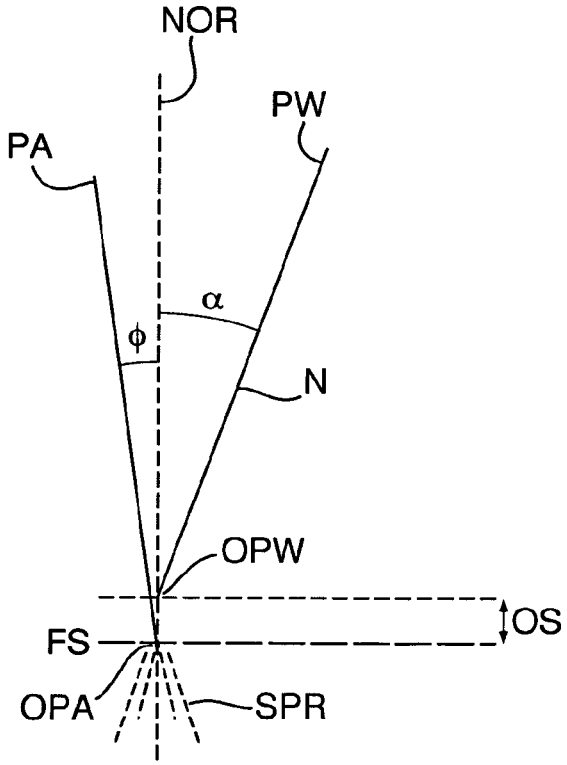
FIG. 3 is a detailed drawing of nozzles

Referring to FIG. 3, the nozzle (N) has the outlet port for liquid (OPW) positioned away from the surface of the substrate relative to the outlet port for air (OPA), offset by a distance (OS). The angle of incidence of the outlet port for liquid with respect to the substrate (FS) is defined by the angle $\alpha$. The angle of incidence of the outlet port for air with respect to the substrate (FS) is defined by the angle $\phi$. The dashed line NOR represents an imaginary line which is normal to the surface of the substrate. As is apparent, in this embodiment of the nozzle the angle $\alpha$ is greater than the angle $\phi$. The air exits from the nozzle through outlet port for air (OPA) and the liquid exits through the outlet port for liquid (OPW).

Figure 4:
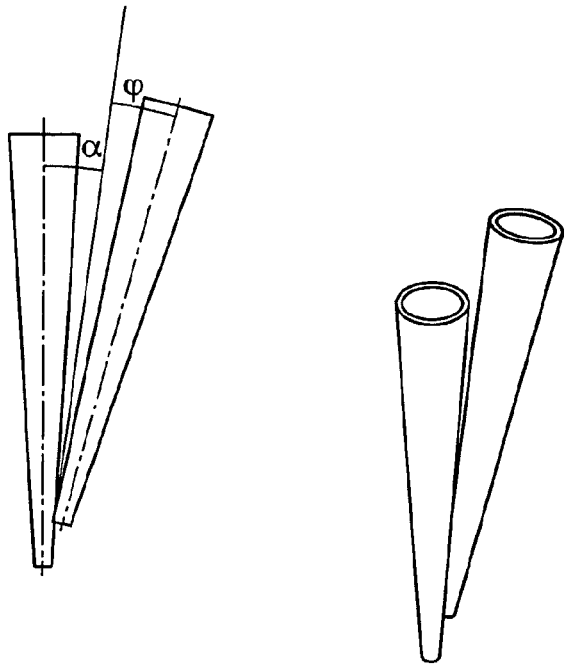
FIGS. 4 and 5 show 3-D drawings of the air-water jet nozzles in different embodiments.

FIG. 4 shows a 3-D view of the configuration of FIG. 3

Figure 5:
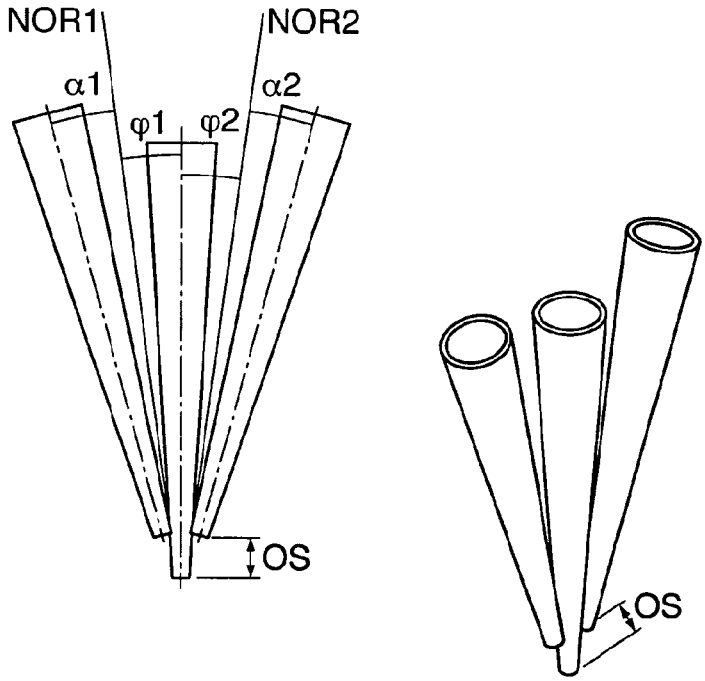

FIG. 5 shows a 3-D view of a configuration with 1 air nozzle and 2 water nozzles.

EXAMPLES

The invention will now be demonstrated with examples.

Example 1

Cleaning of Soiled Stainless Steel Tiles

Soiling Protocol

Substrate: Lightly brushed steel tiles SS 304 (10 cm×10 cm)

Oil: Dehydrogenated Castor Oil

Method

- Tiles are edged with masking tape to leave an exposed area of 5*5 cm
- Spread 2 ml of oil evenly using a metal rod on the exposed area
- Remove the masking tape
- Bake in oven @100° C. for 1 hour Cleaning Method Soiled tiles prepared by the above method are cleaned with:

1. air-water jet device according to the invention dispensing a cleaning formulation; and compared to
2. a regular brush (with the same amount of the formulation).

Formulation

Sodium dodecyl sulphonate (0.04 gram/Liter)

Flow rate: 30 ml/min

Time: 1 min

Air Pressure: 4 bar gauge

To quantify the cleaning efficiency the tiles cleaned with air jet and brush are exposed to a ten member test panel.

The cleaning results for the tiles cleaned by the air-water jet are found to be superior to those obtained by the comparative conventionally cleaned tiles.

Example 2

Cleaning of Hard Surface

A number of hard surface cleaning compositions are suitable for use with the air-water jet device.

Bathroom Cleaning Compositions

Suitable acidic bathroom cleaning formulations are given below.

TABLE 1

Acidic bathroom formulations

| | | 1 (% w) | 2 (% w) | 3 (% w) | 4 (% w) |
|---|---|---|---|---|---|
| Surfactants | Ethoxylated Alcohol C9-C11 8EO | 2 | 4.5 | 0.9 | |
| | alcohol ethoxylate type 1D-10 | | | | 3.5 |
| | Na Alkyl Ether Sulphate | | | 4 | |
| Polymers | Polyacrylate | | 0.5 | | |
| | XANTHAN GUM | | | | 0.2 |
| Solvents | Dipropylene Glycol (mono) butyl ether | | | | 1 |
| | Water | 98 | 95 | 95.1 | 95.3 |
| pH | | 3.8 | 4.3 | 3.5 | |

The formulations in the above table provide improved cleaning of soap scum and lime scale when used in the air-water jet device according to the present invention.

Kitchen Cleaning Compositions

Suitable alkaline kitchen cleaning compositions are given below.

TABLE 2

Alkaline kitchen formulations

| | | 5 (% w) | 6 (% w) | 7 (% w) | 8 (% w) |
|---|---|---|---|---|---|
| Surfactants | Ethoxylated Alcohol C9-C11 5EO | 3.3 | | | 5 |
| | Ethoxylated Alcohol C9-C11 8EO | | 5 | | |

TABLE 2-continued

| Alkaline kitchen formulations | | 5 (% w) | 6 (% w) | 7 (% w) | 8 (% w) |
|---|---|---|---|---|---|
| | Na Alkyl Ether Sulphate | 1.65 | | | |
| | Alkyl Polyglucoside C8-14 | | | 2.5 | |
| Polymers | Polyacrylate | | 0.4 | | |
| | Acrylic Polymer | | | | 0.15 |
| Solvents | Dipropylene Glycol (mono) butyl ether | 1 | 1 | | 1 |
| Fatty Acids | Coconut fatty acid | 0.09 | 0.18 | | |
| Other | Monoethanolamine | 4 | 1 | | 4 |
| | Water | 89.96 | 92.42 | 97.5 | 89.85 |
| pH | | 11.3 | 11 | 7.9 | |

The formulations in the above table provide improved cleaning of fatty soil (DHCO dehydrogenated castor oil) when used in the air-water jet device according to the present invention.

Other Cleaning Compositions

Other cleaning compositions are given below. These compositions include a steel cleaning composition (composition 9), an oven cleaning composition (composition 10), a window cleaning composition (composition 11) and a multi-purpose cleaning composition (composition 12)

TABLE 2

| Specialist cleaning formulations | | 9 Steel (% w) | 10 Oven (% w) | 11 Window (% w) | 12 Multi-purpose (% w) |
|---|---|---|---|---|---|
| Surfactants | Ethoxylated Alcohol C9-C11 5EO | 0.72 | | | |
| | alcohol ethoxylate type 1D-10 | 1 | | | |
| | secondary alkane sulphonate | 3 | | | |
| | Sodium Octyl sulfate | | | | 1 |
| | Eptyl ? PAS | | | | 1.5 |
| | Na Alkyl Ether Sulphate | | 4.41 | 0.2 | |
| Polymers | XANTHAN GUM | | 0.6 | | 0.05 |
| Solvents | Dipropylene Glycol (mono) butyl ether | 1 | | | |
| | Propylene glycol propyl ether | | | 2.9 | 3 |
| Fatty Acids | Coconut fatty acid | 0.2 | | | |
| Other | 2-AMINO-2-METHYL-PROPANOL (AMP) 90% | | 1.5 | | |
| | Water | 94.08 | 93.49 | 96.9 | 94.45 |
| pH | | 2.5 | 13.5 | 11 | 3 |

The formulations in the above table provide improved cleaning. All of the above cleaners are suitable for cleaning fatty soil from the respective surfaces. The steel cleaner is suitable for cleaning stainless steel cooker top, the oven cleaner is suitable for cleaning enamel surfaces, and the window cleaner and the multi-purpose cleaner are suitable for cleaning glass surfaces, when used in the air-water jet device according to the present invention.

Example 3

Cleaning of Mould Covered Tiles

In this example the cleaning performance of the air-water jet on tiles stained with mould is demonstrated.

Preparation of the Mould Paste

The organism used was *Aspergillus niger* ATCC 16404, as specified by BS EN 1275:1997 and BS EN1650:1998. (Additional organisms found to be suitable for use with this method include *Cladosporium cladosporioides* JAP 001, *Penicillium chrysogenum* IMI 178514 and *Aspergillus niger* ATCC 6275.)

Sterile forceps were used to remove one bead from each vial of the microorganisms which were kept in a freezer having temperature of −80° C. The beads were streaked over the agar surfaces. The plates were then placed in an incubator for seven days at 28-30° C. The plates were then removed from the incubator. Then swab was used to transfer the spores from an original plate onto new malt extract agar plates. The number of plates inoculated determines the quantity of spore suspension produced (one plate typically yields approximately 6 ml of suspension). The original plates were discarded. The plates were again placed in an incubator for nine days at 28-30° C. The plates were removed from the incubator and a spatula used to tip the contents of the plates (including the agar) into an autoclavable beaker. The beaker was filled with distilled water. The top of the beaker was covered with aluminium foil and sterilised by autoclaving at 121° C. for 15 min. Following autoclaving the beaker was contained circles of mould from the plates floating in dilute malt extract agar. The next stage was performed before the dilute malt extract agar cooled to below 50° C. The dilute malt extract agar was poured off from the beaker, it was ensured that the circles of mould remained in the beaker. Boiling water was poured into the beaker. The beaker was left standing for a few minutes, and then poured off the hot water; once again it was ensured that the circles of mould would remain in the beaker. The previous step was repeated once. The circles of mould then scraped out of the beaker and then grinded them with a pestle and mortar. The grinding was carried out until all lumps have been vanquished. Sufficient distilled water was added to make the paste thin. It was then decanted into a powder bottle and stored at 2-4° C. for a maximum of one month. After that it was ready for use in the experiments.

Preparing Mould Stained Tiles

Unglazed, porous, biscuit-coloured tiles (ex H&R Johnson, UK) were cut into the desired size. The tiles were then cleaned by steeping them into a bucket filled with dilute Domestos Thick Bleach (ex Unilever, UK) for 1-2 hours and draining off the bleach afterwards and re-filling the bucket with deionised/distilled water and steeping the tiles again overnight. The rinse step is then repeated twice and the water is drained off.

The tiles were then put in covered a sealable autoclavable tray facing upwards. The trays were covered in tray in autoclavable paper, and autoclaved at 121° C. for 15 minutes and dried overnight at 60° C.

The mould mixture (see above) was pipetted onto each tile to completely cover the surface, such that the tile is covered, but not using so much that it drips off the edges of the tiles. The mixture was allowed to soak into the tiles for 3 hours.

Autoclavable incubation boxes were prepared for the tiles. When the mixture had completely soaked into the tiles, they were put into the in the boxes, covered with Clingfilm and put into a autoclavable plastic bags. The bags were sealed with autoclave tape.

The bags were incubated at 28-30° C. for one week, before being autoclaved at 121° C. for 15 minutes.

After cooling down the boxes with tiles were removed from the bags and the tiles were further dried 20° C.±1° C. When dry the tiles are ready for use in bleaching experiments.

Tile Cleaning

The assessment of cleaning of the tiles was done by panel score. Panellists were asked to give a score from zero to five. For fully mould cover tiles the score is '0' and for clean tiles the score is '5', anything in between was scored accordingly by the panellists. The higher the score the better the cleaning is. The total number of panellists was eleven.

All experiments with Air water spray were carried under the following conditions Air pressure 450 kPa Liquid flow rate: 10 ml/min Nozzle diameter: 0.5 mm (both air and water nozzles)

The air jet nozzles compared with the normal cloth applicator which is generally used for house-hold cleaning. For both cases the time of application was 30 seconds. The data is presented below in Table 3. And as cleaning solution water was compared to Dettol® Mould and Mildew Remover (ex Reckitt Benckiser) applied neat and Dettol® Mould and Mildew Remover applied 10× diluted.

TABLE 3

| Cleaning Solution (5 ml) | Score (Cloth Applicator) | Score (Ait-jet device of the present invention) |
|---|---|---|
| Water | 1.1 | 2.8 |
| Dettol ® | 4.4 | 4.9 |
| Dettol ® diluted 10 times with water | 1.4 | 4.8 |

In the above table the Score recorded is the average of the reading of the panellists. Dettol® is a well known mould and Mildew Remover manufactured by Reckitt Benckiser containing 2.5% sodium hypochlorite bleach.

From the above data it is evident that current process of using air-water-jet device gives superior cleaning effect than regular cloth applicator, even at diluted use of the mould remover composition or water alone.

Example 4

Cleaning Data of the Device Relative to the Positioning of the Two Nozzles and Offset Between them The qualitative data to prove that offset between the nozzles responsible for better cleaning is already provided in Example 2.

The quantitative data to prove that offset provides better cleaning, experiments were done on a ceramic surface stained with model stain (precipitated chalk: 55 g, liquid paraffin: 40 g and stearic acid: 0.6 g) with the air-water jet using only air and water and compared with the device that has no offset and a reversed offset. The results are scored on a 0-10 scale.

The results of the experiment are tabulated below in Table 3:

TABLE 3

| Air outlet port | Water outlet port | Offset, mm | ΔR |
|---|---|---|---|
| Closer to substrate | Away from substrate | 5 | 6.8 |
| Away from substrate | Closer to substrate | 5 | 5.5 |
| Together with water outlet port | Together with air outlet port | — | 5.3 |

The data in Table 3 indicates that superior cleaning is obtained when the water nozzle is positioned at an offset relative to the air nozzle such that the water nozzle is further away from the substrate that the air nozzle as compared to when they are positioned together or at an offset in reversed order.

The invention claimed is:

1. A process for cleaning a surface of a substrate with a cleaning device comprising:

providing an air-water jet device comprising a first nozzle and a second nozzle;

wherein the first nozzle is in fluid communication with a feed water source;

wherein the second nozzle is connected to a source of compressed air; and wherein both nozzles are positioned relative to a central axis;

wherein the first nozzle is at an angle of between 1 and 60° relative to the central axis;

wherein the second nozzle is at an angle of between 1 and 45° relative to the central axis;

wherein the central axis is normal to the surface of the substrate;

wherein a mouth of the second nozzle is positioned more forward in the direction of the flow along the direction of the central axis than a mouth of the first nozzle, wherein the offset distance between the mouth of the first nozzle and the second nozzle is between 0.5 and 5 mm in said direction;

wherein the air-water jet device is configured so as to result in mixing of the air and the feed water external from the jet device;

wherein the first nozzle and the second nozzle are positioned so as to result in:

(i) mixing of the air and the feed water at the mouth of the second nozzle when the device is in operation and (ii) water from the first nozzle forming a film around the second nozzle when the device is in operation;

and wherein the second nozzle does not co-axially surround the first nozzle;

wherein the process comprises spraying water from the first nozzle such that a film forms around the second nozzle and wherein the process comprises spraying air from the second nozzle such that a spray of water and air is formed.

2. A process according to claim 1 further comprises the step of depositing a benefit agent to the surface of the substrate.

3. A process according to claim 1, wherein the mouth of the first nozzle of the device has an opening of 0.05-7 $mm^2$.

4. A process according to claim 1, wherein the mouth of the first nozzle of the device has an opening of 0.2-3.5 $mm^2$.

5. A process according to claim 1, wherein a distance between the mouth of the first nozzle of the device and the wall of the second nozzle is less than 1 mm.

6. A process according to claim 1 wherein the device further comprising a handle.

7. A process according to claim 1 wherein the device comprises a head, wherein the head comprises at least one of bristles, other abrasive, and scouring elements.

8. A process according to claim 7 wherein the head:

(i) comprises bristles and (ii) is electrically operated.

9. A process according to claim 1, wherein the device is hand held and connected to a separate unit, wherein the separate unit comprises:

(i) a compressor configured as an air source and (ii) a reservoir configured:

a. as a water source and b. for holding a liquid.

10. A process according to claim 9, wherein the reservoir comprises a cleaning composition comprising:

a. 0.01 to 10% w surfactant b. 0.01 to 2% w polymer c. 0.1 to 10% w solvent.

* * * * *